US005203609A

United States Patent [19]

Stoeckl

[11] Patent Number: 5,203,609

[45] Date of Patent: Apr. 20, 1993

[54] DENTAL PATIENT CHAIR WITH CHANGING PATIENT POSITION WHILE MAINTAINING MOUTH POSITION

[75] Inventor: Klaus Stoeckl, Bensheim, Fed. Rep. of Germany

[73] Assignee: Siemens Aktiengesellschaft, Munich, Fed. Rep. of Germany

[21] Appl. No.: 808,728

[22] Filed: Dec. 17, 1991

[30] Foreign Application Priority Data

Dec. 19, 1990 [EP] European Pat. Off. ..... 90124831.0

[51] Int. Cl.[5] ..... A47C 1/02; A47C 1/06; A47C 1/12

[52] U.S. Cl. ..... 297/344; 297/346; 297/330

[58] Field of Search ..... 297/317, 322, 330, 361, 297/344, 345, 346, 347, 348

[56] References Cited

U.S. PATENT DOCUMENTS

| | | | |
|---|---|---|---|
| 3,804,460 | 4/1974 | Leffler | 297/347 X |
| 3,934,928 | 1/1976 | Johnson | 297/330 X |
| 3,984,146 | 10/1976 | Krestel et al. | 297/330 |
| 4,128,797 | 12/1978 | Murata | 297/330 X |
| 4,650,247 | 3/1987 | Berg et al. | 297/330 X |

*Primary Examiner*—James R. Brittain
*Assistant Examiner*—James M. Gardner
*Attorney, Agent, or Firm*—Hill, Steadman & Simpson

[57] ABSTRACT

A dental patient chair has a seat, backrest and headrest which are adjustable in both the horizontal and vertical directions relative to a base part to establish a given chair position for treatment. The patient chair includes a controllable positioning arrangement which enables positioning a reference point or "mouth point" in a particular position in both the vertical and horizontal directions and enables varying this point in view of changes either in the size of the patient, the size of the attending person, or a change between a sitting and standing position for the attending person.

18 Claims, 5 Drawing Sheets

DENTAL PATIENT CHAIR WITH CHANGING PATIENT POSITION WHILE MAINTAINING MOUTH POSITION

BACKGROUND OF THE INVENTION

The present invention is directed to a dental patient chair which contains a base part on which an upper chair part comprising a seat, backrest and headrest for the patient is height-adjustably and longitudinally displaceably mounted. The dental patient chair includes an adjustment arrangement having controllable drives by which the height adjustment and longitudinal displacement of the upper chair part relative to the base can be accomplished and further includes additional adjustment devices for adjusting at least the headrest part and the backrest part.

In dental patient chairs, it is known to vary the bearing parts, such as the seat, backrest and head support, in accordance with the required treatment positions with the assistance of suitable adjustable means that can be of a mechanical, electromechanical or hydraulic type. On the basis of such an adjustment, the position, both relative to one another as well as relative to a stationary reference plane such as a wall, floor or chair base, can be varied.

It is also known to define standard treatment positions by control programs, wherein the control programs can be fashioned both fixed, as well as individually variable. Usually, a modern patient chair is currently equipped with three control programs that can be activated or used, as needed, by pressing keys.

Although it is a relief for the treating person, who may be either a physician and/or an assistant, to obtain the different treatment positions in a relatively simple manner by pressing a key and to, thus, be able to set them, it is nonetheless inconvenient for the treating person that, when, for example, the sloping position of the backrest and/or the headrest or head support must be changed during a treatment, the chair must, again, be readjusted to the position previously set to the optimum work attitude. Given such a change in the treatment position, namely the "mouth point", of the patient necessarily changes and results that a correction of the position of the treating person and/or his equipment, such as instrument holders, trays, etc., become necessary for the purpose of adapting to the modified treatment position. The term "mouth point", used hereinabove and hereinafter, is a reference point which is definable in the region of the preparation location of the patient's mouth in relationship to both a horizontal and to a vertical reference plane.

The same is also true given a change of patients, because the treatment position set once for optimum working conditions for one patient is no longer optimally suited, given another patient who usually has a different physical size. Therefore, the position must be corrected.

SUMMARY OF THE INVENTION

The object of the present invention is to achieve an improvement in comparison to previously known dental patient chairs by creating a dental patient chair wherein the complicated corrections and readjustments of an established chair position can be eliminated when given either a change in the treatment position or a change of patient and/or treating person.

To accomplish these goals, the dental patient chair contains a base part on which an upper chair part comprising a seat, backrest and headrest part for the patient is height-adjustably and longitudinally displaceably mounted, adjustment means having control drives for at least height adjustment and longitudinal displacement of the upper chair part relative to the base part, additional adjustment means for adjusting at least a headrest part and a backrest support part relative to the seat, position sensor means being allocated to each of the adjustable chair parts for determining the respective actual position of each of the chair parts, means for inputting a selected position corresponding to a position of a reference point facing toward the headrest part, means for storing this selected position, and control means for calculating the actual value for the reference point and providing control signals for positioning the chair parts through the adjustment means for height-adjustment and longitudinal displacement and for actuating the additional adjustment means for the purpose of keeping the actual value constant in accordance with the inputted desired or targeted value for the reference point. The chair in accordance with the present invention may also include means for inputting and storing values for a plurality of different chair positions that are defined positions of the adjustable chair parts.

In accordance with the invention, it is possible to set the patient chair to an optimum "mouth point" aligned to the patient to be treated before the beginning of the treatment. This optimally set "mouth point" is then also preserved, given changes in the sloping attitude of the backrest and/or of the headrest to be undertaken in the course of treatment. This ultimately means that the treating person need not change his work attitude nor his equipment and device. A clear simplification and improvement of the work ergonomics can, thus, be achieved.

The retention of the optimally set "mouth point" advantageously occurs in that the position for the headrest part is stored as a targeted, rated or selected value for the "mouth point" that has been set and all "mouth points" intrinsically changing due to a variation of the angular attitude of the headrest part or the backrest are corrected to the previously-set "mouth point". This correction advantageously automatically occurs during the change of the backrest or headrest part so that the patient's head is practically only turned around the "mouth point".

As already mentioned, the "mouth point" is a reference point allocated to the head support or headrest part that, for example, can lie on the angle bisector and halfway across the open mouth of a patient's head of average size, what is referred to as a "standard patient head". The reference point can be calculated in that an empirically identified value corresponding to the dimensions of the "standard patient head" and corresponding to the perpendicular spacing of this point from the plane defined by the coordinates of the headrest part is added to the coordinates for this above-mentioned plane.

One, therefore, proceeds on the basis of the following considerations: The position of the bearing part in space can be defined by the planes of an x-, y-, z-coordinate system. When this coordinate system is two-dimensionally viewed, with the third dimension being relatively insignificant for supporting the patient, then the position of the bearing part can be defined in simplified fashion in the coordinate system by a straight line with the assistance of two points or of one point and an angular relationship. Thus, for example, the position of the headrest with reference to an arbitrarily selectible zero point of an x/y coordinate system can be defined by the angle that the headrest assumes with reference to a horizontal reference plane or by the x- and y-coordinates of two points that lie on a straight line and proceed in the longitudinal plane of the backrest. In the above, one coordinate, such as the x-coordinate, can indicate the spacing from a vertical reference plane, such as a wall, cabinet or apparatus space, and the y-coordinate indicates the spacing from the horizontal reference plane, which may be the floor. The "mouth point" can, thus, be precisely defined by the coordinates of the x/y coordinate system with reference to a vertical and to a horizontal reference plane. These coordinates can be stored as targeted, rated or desired values in a computer and can be continuously compared to actual values. Given a deviation of the values, the upper chair part is adjusted by a height adjustment and/or longitudinal displacement for the purpose of retention of the "mouth point" corresponding to the input rated value.

The established "mouth point" can be advantageously input as a variable quantity. When the "mouth point" is varied in the x-direction, then an adaptation to the equipment, such as cabinets, neighboring the patient chair is advantageously possible. When, by contrast, the "mouth point" changes only in the y-direction, then an adaptation to the physical size of the treating person is advantageously possible.

Let is be pointed out at this point that the proposed variation of the "mouth point" for the purpose of adaptation to the equipment, as well as to the physical size of the treating person and the patient, need not necessarily be coupled with the above-mentioned retention of the "mouth point", given a change in the sloping attitude of the backrest part and/or the headrest part during the change of a treatment. However, this variation of the "mouth point", by contrast, is also advantageous in and of itself.

Given patient chairs having a relatively long backrest, whereby, thus, the head of the patient lies against the backrest itself, the head support or headrest part can be fashioned as a head cushion longitudinally displaceable vis-a-vis the backrest. In addition, appropriate position sensors are present in the region of the head support and it is conceivable to provide position sensors in the backrest itself in the region of the head support, for example in the form of pressure sensors corresponding to the bearing pressure of the patient's head. With the assistance of these sensors, the position of the patient's head can be acquired in relationship to the backrest.

It is especially advantageous to provide the headrest as a separate head support held adjustably vis-a-vis the backrest at least in the longitudinal direction and to provide an appropriate position sensor between the head support mount and the backrest that is stationary in comparison thereto. The values acquired by the position sensor can correspond to the coordinate values in the above-mentioned x/y coordinate system, which defines the position of the support part with reference to a horizontal and to a vertical reference plane.

Particular advantages can be achieved when one or more bearing taxonomies or systems defined by programs are provided. Given such a bearing taxonomy as produced, for example, by the Institut der Arbeitswissenschaften Darmstadt (see W. Rohmert/I. Mainzer/P. Zipp, "Der Zahnarztim Blickfeld Ergonomie"), the individual chair positions can be set to be freely selectible reference heights (y-coordinates) in accordance with the selected working height or, respectively, physical size of the treating person. When these values, which correspond to the optimally set "mouth points", are stored, all programs of the provided bearing taxonomy are oriented to this optimum "mouth point" that has been set. Given the call-in of an arbitrary programmed treatment position, both the working height, i.e., the height of the reference point representing the "mouth point" as well as the spacing in horizontal relation to a vertical reference plane, is maintained for all working positions. This optimum "mouth point" is preserved for another patient having a different physical size in that the upper chair parts, in adaption to the head support, are correspondingly readjusted to the other physical size in the x- and y-directions.

Other advantages and features of the invention will be readily apparent from the following description of the preferred embodiments, the drawings and claims.

DESCRIPTION OF THE PREFERRED EMBODIMENTS

Figure 1:
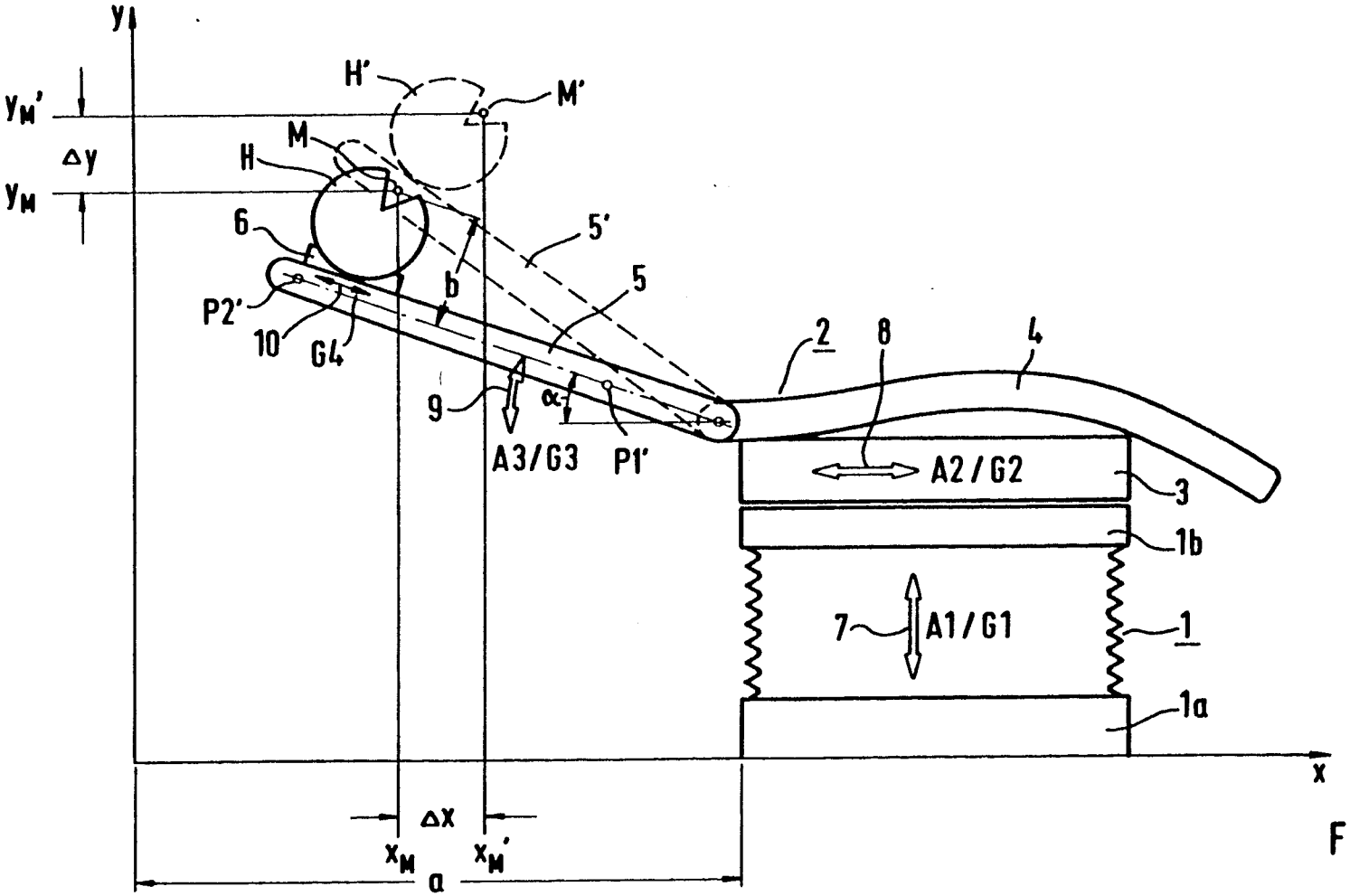
FIG. 1 is a schematic side view of a first embodiment of the patient chair in accordance with the present invention.
Figure 2:
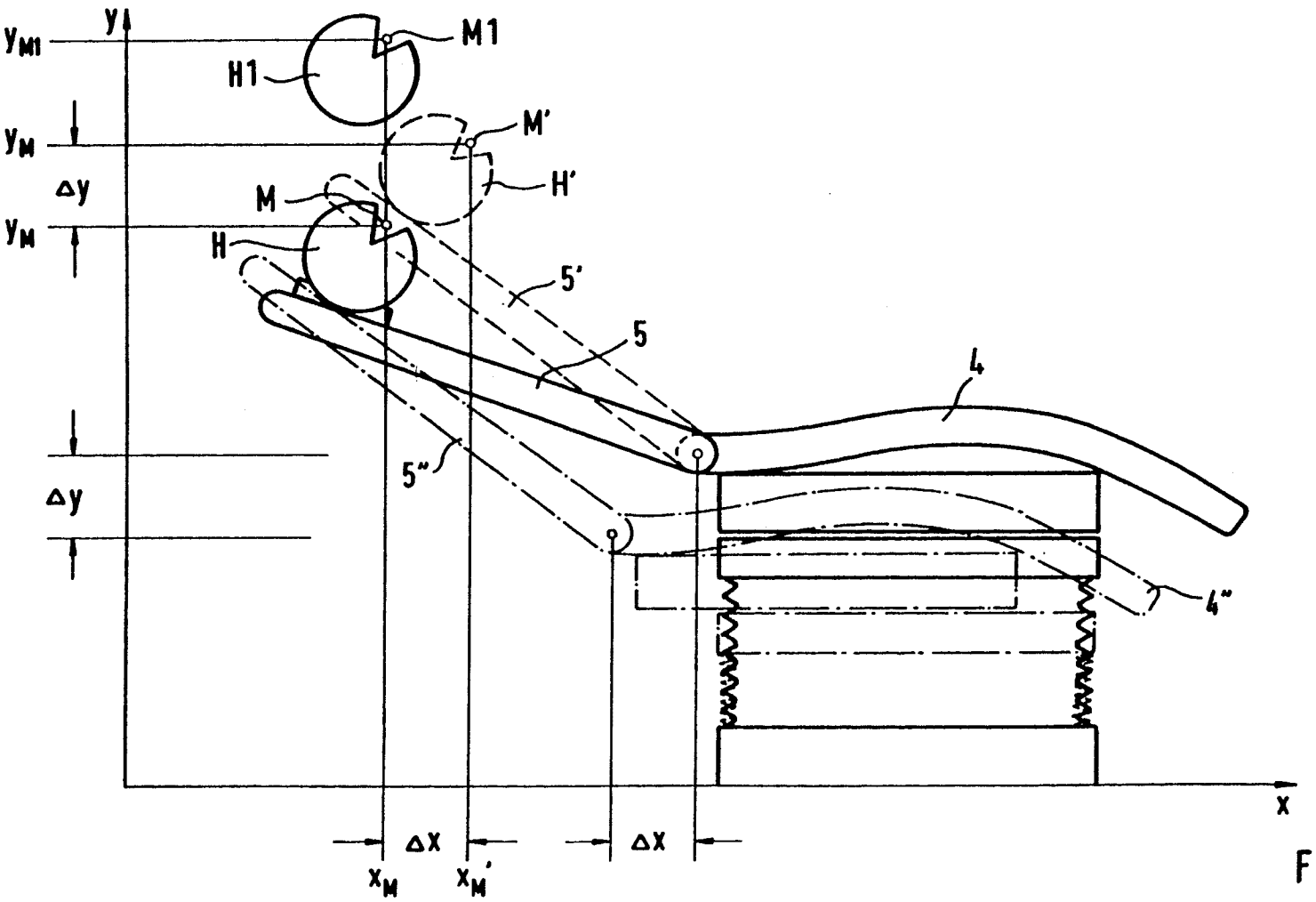
FIG. 2 is a schematic side view of the chair of FIG. 1 showing changes in the various positions.

The principles of the present invention are particularly useful when incorporated in a dental treatment chair, which is illustrated in simplified form in FIGS. 1 and 2. The treatment chair contains a stationary base part 1 on which an upper chair part 2 is generally held in a height-adjustable position. The base part contains a pedestal 1*a* and an upper base part 1*b* that is height-adjustable relative to the pedestal 1*a*. The upper chair part contains a carrier 3 which is adjustable along the upper base part 1*a*, a seat 4 and a backrest 5 are held on this adjustable carrier 3. A head support or headrest part 6 is also longitudinally displaceable, as indicated by the arrow 10 on the backrest 5. A control drive A1 is provided in order to adjust the upper chair part 2 in height relative to the base or pedestal 1*a*, as indicated by the arrow 7. Another adjustable, controllable drive A2 enables the adjustment in the direction of the arrow 8 of the carrier 3 on the upper base part 1*b*. The backrest 5, whose sloping attitude can be varied in the direction of the arrow 9, is shifted by a controllable drive A3. Since the arrangement of the adjustable drive is inherently known, they are not shown in greater detail. Let it be merely pointed out that both hydraulic, as well as pneumatic, but, preferably, electrical drives basically come into consideration.

The adjustable chair parts have position sensors G1–G4 allocated to them, with which the respective actual position of the chair part with reference to a horizontal and to a vertical reference plane can be acquired. The sensors G1, G2 and G4 are linear path or distance sensors, whereas the sensor G3 is fashioned as an angular sensor. The position of the chair parts 2–6 can be unambiguously defined with the assistance of the position sensors relative to an x/y coordinate system, whose x-axis lies in a horizontal reference plane, preferably the plane of the floor, and whose y-axis lies in a vertical reference, preferably the plane of a room wall, from which the base part 1 has a defined, predetermined spacing a. Thus, for example, the position of the backrest can be defined with reference to a reference plane by the coordinates of the two points P1′ and P2′ that proceed through a straight line proceeding along the backrest and/or by the angle $\alpha$ of inclination of the backrest.

A "mouth point" M of a schematically illustrated "standard patient head" H has a position which is defined in the coordinate system by the coordinates $x_M$, $y_M$. The "mouth point", which is intended to represent a reference point corresponding to a preparation location here, can, preferably, be defined so that it lies on the angle bisector between the upper jaw and the lower jaw of the open patient mouth and approximately halfway in the "mouth depth". Proceeding from this "mouth point", a vertical spacing b from the above-mentioned plane of the backrest 5, which plane proceeds through the two points P1′ and P2′, occurs. Based on the dimensions of an average patient head ("standard patient head") to be empirically calculated, the "mouth point" can, therefore, be unambiguously defined in an x/y coordinate system.

When the inclined attitude of the backrest 5 is changed, for example brought into the position 5′ indicated in broken lines, then the new position of the "mouth point" M′ would necessarily change by the dimensions $\Delta x$ and $\Delta y$, with reference to the coordinate system. As may be clearly seen from the comparison of the two positions M and M′, a change in the "mouth point" also means a change in the working attitude of the attending person. With reference to the exemplary embodiment, the attending person would, thus, have to correct his working position, as well as the position of his apparatus and equipment which were set for the working position by the dimensions $\Delta x$ and $\Delta y$.

In accordance with the first proposal of the invention, this correction is avoided in that, given a change in the inclined attitude of the backrest, the adjustment drives A1 and A2, that effect the height adjustment and longitudinal displacement of the upper chair parts, are synchronously adjusted for the purpose of maintaining the "mouth point" or, respectively, keeping the "mouth point" constant. Further explanation shall be provided when describing the block circuit diagram in FIG. 5. The result of this synchronous adjustment is shown in FIG. 2. Proceeding from the initial position shown in solid lines that corresponds to positions shown in FIG. 1, the position shown dot-dash occurs given a modified inclined attitude of the backrest. While, thus, the inclined attitude of the backrest is being changed from 5 to 5′, the upper chair part is synchronously moved lower, first, by the dimensions $\Delta y$ and, second, is moved toward the reference plane y by the dimension $\Delta x$, i.e., toward the attending person, without the "mouth point", thus, being varied so that the backrest takes a position 5″ shown in broken lines.

In accordance with a further proposal of the invention, likewise shown in FIG. 2, the "mouth point" M can be individually varied in the y-direction, for example can be brought into a position referenced M1. An adaptation to the physical size of the attending person is advantageously possible on the basis of such a modification. When the "mouth point" is varied in the y-direction, for example because the attending person would like to change from a seated into a standing treatment position, the new "mouth point" M1 can, as set forth above, again be advantageously preserved given all the changes in the inclined attitude of the backrest and/or the head support.

Figure 3:
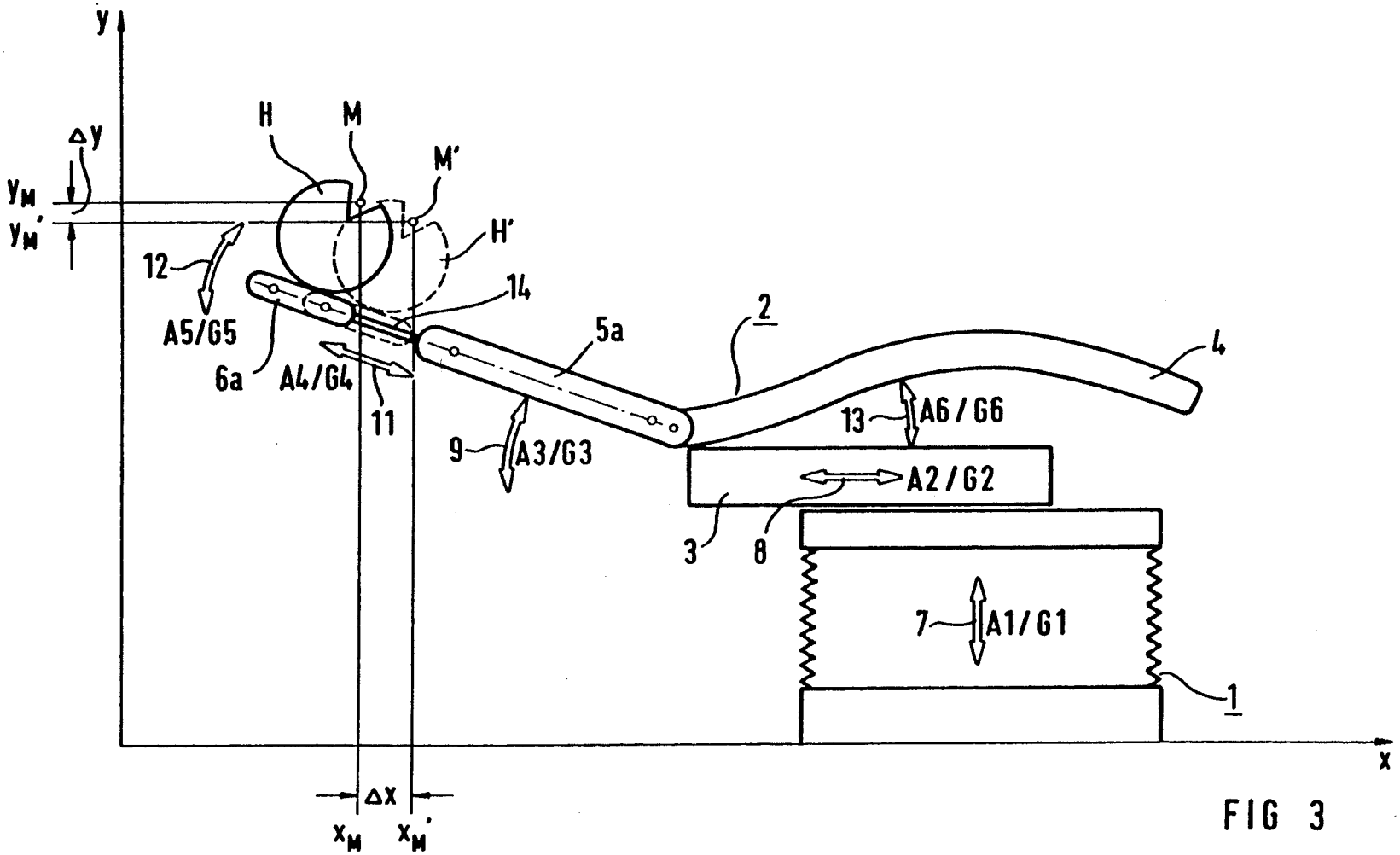
FIG. 3 is a schematic side view of a second embodiment of the patient chair in accordance with the present invention.

A second embodiment of the chair is illustrated in FIG. 3. This embodiment differs from the first-mentioned embodiment in that the headrest part 6*a* is fashioned as a separate head support or headrest that is arranged adjustably vis-a-vis a "shorter backrest" 5*a* in the direction of the arrows 11 and 12 and in that the seat 2 and the backrest 5*a* can still be tilted in common in the direction of the arrow 13 relative to the carrier 3. Thus, the seat 2 is pivotably mounted on the carrier 3 and the headrest 6*a* is pivotably mounted on the backrest 5*a*. Accordingly, suitable adjustment means A4, A5 and A6, as well as appropriate sensors G4, G5 and G6 are present. The position of the headrest 6*a* relative to the backrest 5*a* can be acquired with the assistance of sensors G4 and G5. The adjustment means A4 and A5 can be manually adjustable means or they can conceivably and advantageously also be provided with electrical adjustment drives. For adjusting the headrest 6*a* in the direction of the arrow 11, for example, an adjustment motor can be arranged in the inside of the backrest 5*a* and this motor displaces the head support carrier or brace 14 via a toothed rack or the like.

As a result of the head support 6*a* adjustable along the backrest 5*a* in accordance with the direction of arrow 11, it becomes possible to adapt the "mouth point" to different patient sizes in that, given a change in the head support position for a patient having a different physical size, for example a smaller patient, having his head in a position H′ shown in broken lines and relative to the position H shown in bold lines, the upper chair part, as set forth above, is corrected such by the dimensions $\Delta x$ and $\Delta y$ that the "mouth point" M is maintained as a result whereof the attending person need not change his work attitude and also need not change the position of the instruments and equipment which are allocated to the "mouth point" M.

Figure 4:
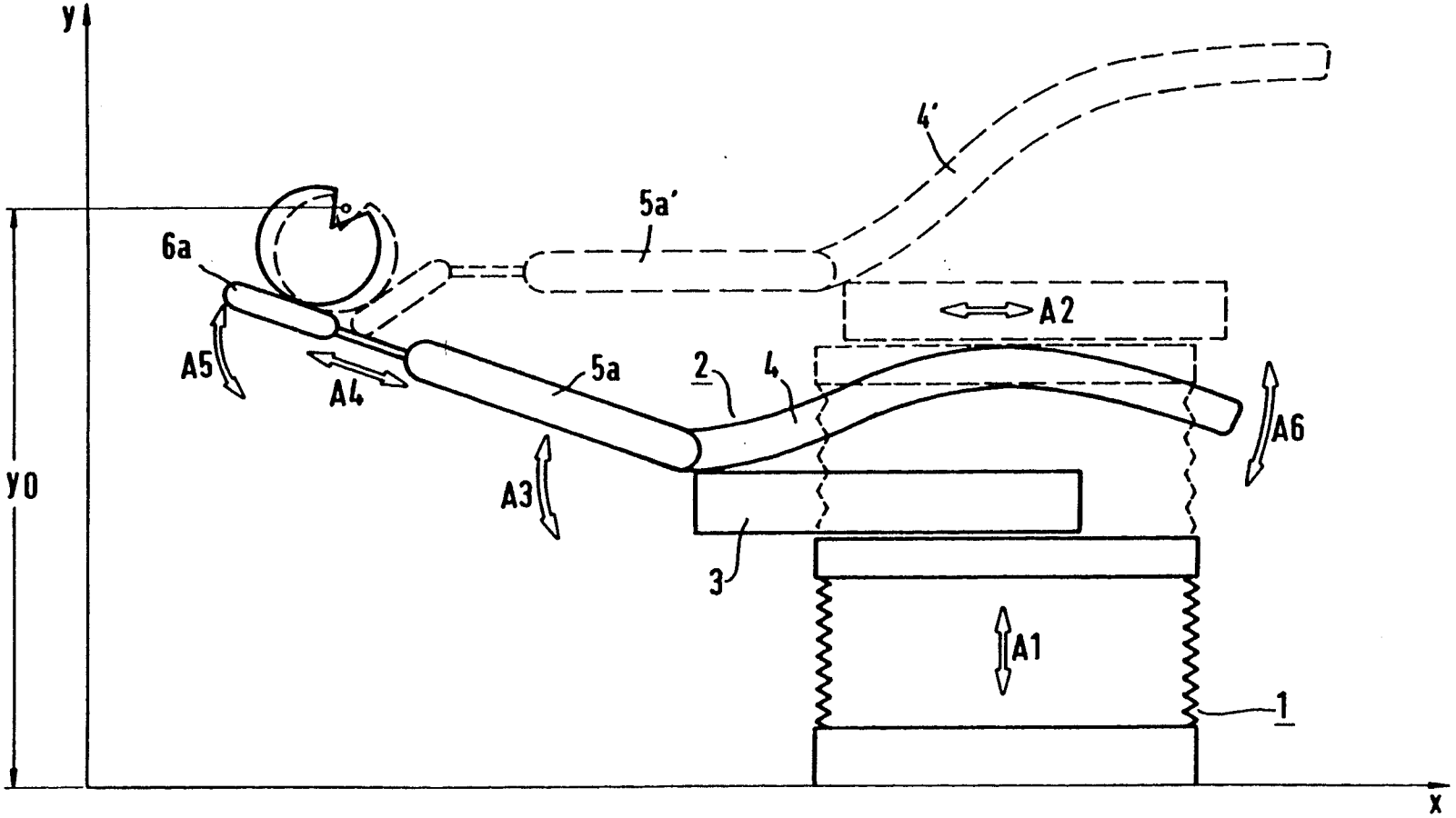
FIG. 4 is a schematic side view of the embodiment of FIG. 3 illustrating substantial changes between a first and second position.

In FIG. 4, the embodiment of the chair of FIG. 3 is shown in two different chair positions that can be typical for two different treatments. The first chair position is shown in solid lines, for example, can be suitable for a seated attending person and for treatment of a lower jaw, whereas the second position shown in broken lines can be typical for treatment of a seated attending person working on the upper jaw. The two chair positions, advantageously defined by a control program, have a common "mouth point" M that is preserved when changing from the first position indicated with solid lines into the second position indicated in broken lines. This ultimately means that the patient's head is merely turned around the "mouth point" M during this change in the treatment position.

As illustrated, when moving from the position shown in solid lines in FIG. 4 to the position in broken lines, the seat 4 and backrest 5*a* shift to the positions 4′ and 5*a*′, respectively, which involves both a change in height, lateral position and also tilting. In addition, the headrest 6a is tilted to a new position relative to the backrest position 5a'.

Figure 5:
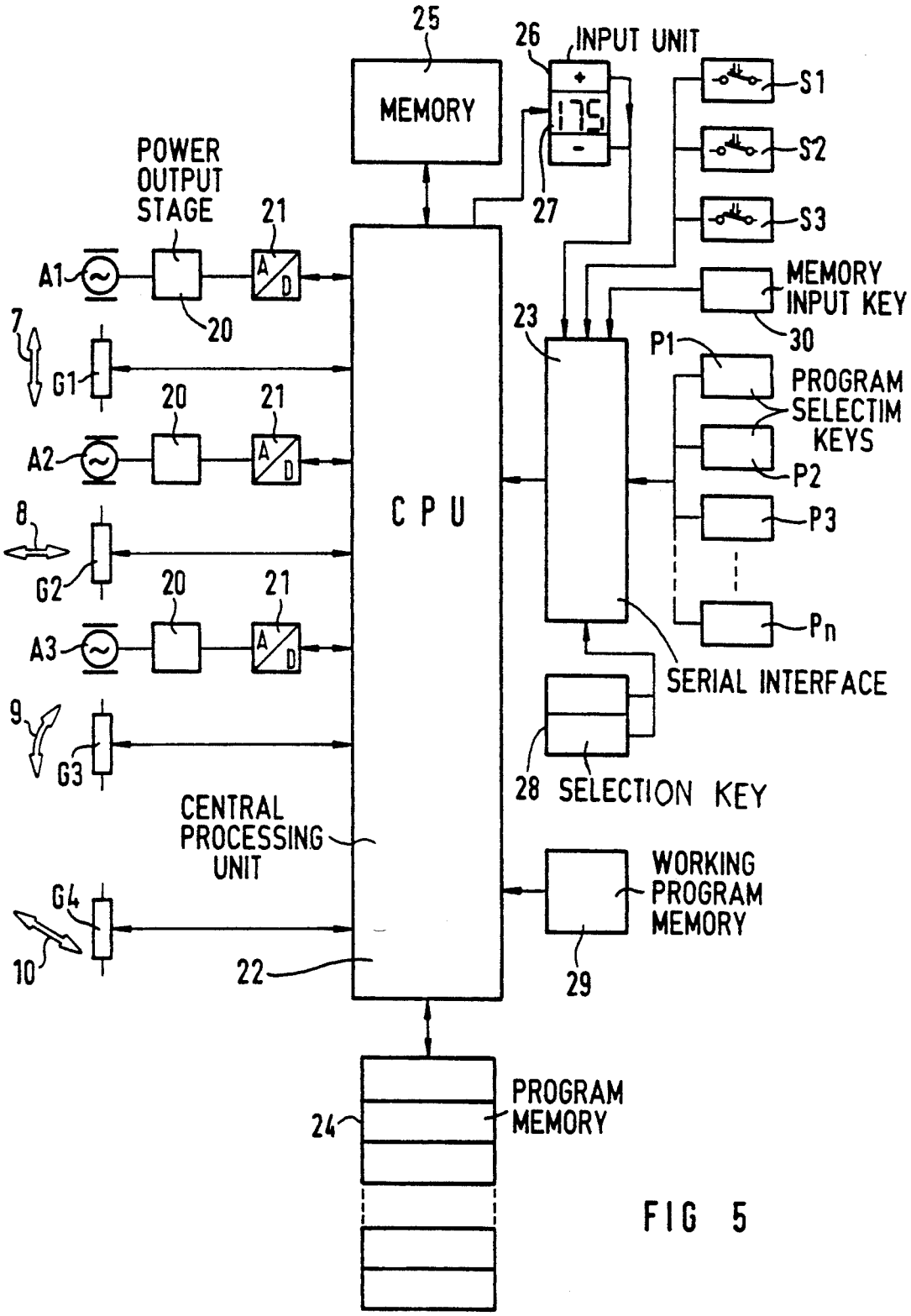
FIG. 5 is a block circuit diagram of a control and calculating unit for control of the positioning of the chair of FIGS. 1 and 2.

The functioning and further advantages of the chair of the invention shall be disclosed with reference to the block circuit diagram in FIG. 5, which is for the embodiment of the chair illustrated in FIGS. 1 and 2.

In the embodiment of the chair in FIGS. 1 and 2, the chair has three controllable drives A1, A2 and A3, which are electromotive drives. The drives are driven by a central processing unit (CPU) 22, which sends additional control signals through three separate digital-/analog converters 21 to three separate power output stages 20, which individually drive each of the electromotive drives forming the drives A1, A2 and A3. Appropriate sensors G1–G4, for example in the form of potentiometers, are provided between these chair parts that are adjustable relative to one another, for example between the pedestal and upper base part, between the upper base part and the carrier, as well as between the seat and backrest, and the backrest and headrest or head support. These sensors supply a signal to the central processing unit 22, which corresponds to the path of adjustment in accordance with their relative position.

Switches S1–S3 are provided and enable manual control of three drives A1, A2 and A3 to enable a height adjustment and longitudinal displacement of the upper chair part, as well as an adjustment of the inclination of the backrest to be initiated. These switches are connected to the central processing unit 22 by a serial interface 23.

Program selection keys P1, P2, P3 . . . Pn are provided and are connected through the serial interface 23 to the central processing unit 22. These program keys allow individual inputtable programs to be called up from a program memory 24. These individually inputtable programs or chair programs for the bearing taxonomies for specific chair positions are assigned to specific dental treatments in accordance with the strategy produced according to the ergonomic points of view. Such a bearing taxonomy, for example, is described in the article by Rohmert et al cited hereinabove.

A memory 25, which stores the x/y values of the "mouth point" M as rated or desired or target values, is connected to the central processing unit 22. Each of the stored target values can be corrected in the central processing unit 22 by a ± input unit 26, which is interconnected through the serial interface 22. The input unit 26 enables changing the preselected target values from a normal value in view of the physical size of the attending person. For example, the y-value can be upwardly or downwardly varied from an average value corresponding to an average size. This corrected value is presented at a display 27 and is automatically taken into consideration when a chair program is called in with the program selection keys P1–Pn.

The optimum "mouth point" M for either a sitting treatment or a standing treatment can be optionally called in with a selection key 28, which, as illustrated, is connected through the serial interface 23 to the central processing unit 22.

An anthropometric table is advantageously taken into consideration in the control program, for example in the program memory 24, and this will result in a prescribed "mouth point" for both a standing and a sitting treatment, corresponding to the size of the attending person. These preset software values, however, are not fixed. On the contrary, they may be expediently individually corrected by the attending person according to his personal requirements insofar as desirable.

The working program of the central processing unit 22 is contained in a memory 29.

It is advantageous when the manufacture of the patient chair has already prescribed "mouth points" for defined treatments and sizes of attending persons, and these are worked into the corresponding program. These preset values can be varied as needed by the attending person by overriding the program.

Insofar as the attending person would like to set the rated value for a "mouth point" himself, this setting occurs as follows: When the patient is seated in the chair, the attending person will bring the chair into a position suitable for the treatment, wherein the "mouth point", for example the center of the preparation location, comes to lie in a work attitude that is beneficial to the attending person. When this position is reached, the x/y value is inputted into the memory 25 as a target value via a memory input key 30 after a corresponding trigger event. The central processing unit 22 thereby acquires the values identified by the corresponding sensors G1–G4, whereby angular values are thereby correspondingly edited in the arithmetic unit of the central processing unit. When a change of the treatment location, for example from an upper jaw to a lower jaw or vice versa, is subsequently initiated, the backrest is changed in terms of its inclined attitude when the actual value of the sensor G1–G3 thereby deriving are compared to the targeted values for the memory 25 in the central processing unit. Any deviations are utilized to vary the longitudinal displacement and height adjustment so that the "mouth point" M is preserved as the chair is moved to a new position. Given a change in the inclined attitude of the backrest, thus, the height position and longitudinal position of the upper chair parts are synchronously changed with reference to the x/y plane.

When the attending person changes his working position, for example from a seated position to a standing position or when it turns out that an attending person having a different physical size is now working at the patient chair, then he can intentionally change the y-value of the "mouth point" with a voluntary act using the assistance of the input unit 26. All programs stored in the program memory 24 are then automatically corrected to this new "mouth point" with such a change in the position of this "mouth point".

When the head part 6 lies on the backrest and can be displaced therealong, the position sensor G4, as already mentioned, can be formed by a suitable pressure-sensitive sensor that has an output of quantity to the central processing unit corresponding to the position in accordance with the bearing pressure that the patient's head exerts on the backrest part 6.

The control means for the embodiment of FIGS. 3 and 4 works in a similar manner to the above-described circuit diagram for the embodiments of FIGS. 1 and 2, however, the headrest part 6a in this second embodiment of FIGS. 3 and 4 is fashioned as a separate head support that is adjustable along the backrest 5a and also arranged tiltable around the axial bearing in the direction of the arrow 12. In addition, the entire upper chair part is arranged tiltable vis-a-vis the carrier part 3. Expediently, additional drives A4–A6 are provided and controlled by the central processing unit and the central processing unit will receive the output from additional sensors G5 and G6. The central processing unit 22 will, thus send out additional command signals to the power output stages for these additional drive units A4–A6 and will receive measured values from the additional sensors G5 and G6 in response to program selections and/or variations set forth by the attending person.

Although various minor modifications may be suggested by those versed in the art, it should be understood that I wish to embody within the scope of the patent granted hereon all such modifications as reasonably and properly come within the scope of my contribution to the art.

I claim:

1. A dental patient chair comprising a base part, upper chair parts consisting of a seat, backrest and headrest part, adjustable means for mounting the upper chair parts on the base part and including controllable drive means for varying at least the height adjustment and longitudinal displacement of the upper chair parts relative to the base part, additional adjustment means for adjusting at least the headrest part and the backrest relative to the seat, sensor means for determining the respective actual position of the respective upper chair parts, means for inputting and storing target values corresponding to predetermined positions for a reference point facing toward the headrest part and control means for calculating the amount of change of the actual position of the headrest part from a targeted position and creating drive signals for the adjustment means to obtain the necessary height and longitudinal displacement of the upper seat parts relative to the base part for the purpose of keeping the actual value constant for the input target value of the reference point.

2. A dental patient chair according to claim 1, which includes input means for varying the target values for the reference point, said input means being connected to the control means.

3. A dental patient chair according to claim 2, wherein said input means varies the target values of the reference point in a vertical direction.

4. A dental patient chair according to claim 3, wherein the target values representing the physical size of the attending person can be set by said input means.

5. A dental patient chair according to claim 2, wherein the input means includes display means for displaying the amount of variation.

6. A dental patient chair according to claim 1, wherein said reference point is defined as a "mouth point" of the average patient's head, whose size is empirically identified, said "mouth point" being situated at a defined distance from said headrest part.

7. A dental patient chair according to claim 1, wherein the reference point can be set according to the physical size of the patient by adjusting the headrest part via a backrest.

8. A dental patient chair according to claim 1, wherein the headrest part fixing the patient's head is in a defined position and is adjustably held in a longitudinal direction on the backrest and providing an output signal for determining the position of the patient's head, which is supported on said headrest part.

9. A dental patient chair according to claim 8, wherein the sensor means for determining the position of the head is a pressure sensor means responding to the bearing pressure of the patient's head.

10. A dental patient chair according to claim 1, wherein the headrest part is constructed as a headrest held longitudinally displaceable via the backrest, said sensor means acquiring the adjustable path of the headrest part between the holder and backrest.

11. A dental patient chair according to claim 1, which further includes means for inputting and storing quantities of a plurality of different chair positions, which define the positions of the adjustable chair parts being connected to the control means and activating controllable drives in order to approach one of the selected different chair positions.

12. A dental patient chair comprising a base part, upper chair parts consisting of a seat, backrest and headrest part, adjustable means for mounting the upper chair parts on the base part and including controllable drive means for varying at least the height adjustment and longitudinal displacement of the upper chair parts relative to the base part, additional adjustment means for adjusting at least the headrest part and the backrest relative to the seat, sensor means for determining the respective actual position of the respective upper chair parts, first means for inputting and storing target values corresponding to predetermined positions for a reference point facing toward the headrest part, second means for inputting and storing quantities of a plurality of different chair positions, which define the positions of the adjustable chair parts, processing means defining the values of said different chair parts to said target values as a common reference point, and control means activating said controllable drives in order to approach one of the selected different chair positions.

13. A dental patient chair according to claim 12, which includes input means for varying the target values for the reference point, said input means being connected to the control means.

14. A dental patient chair according to claim 13, wherein said input means varies the target values of the reference point in a vertical direction.

15. A dental patient chair according to claim 14, wherein the target values representing the physical size of the attending person can be set by said input means.

16. A dental patient chair according to claim 13, wherein the input means includes display means for displaying the amount of variation.

17. A dental patient chair according to claim 12, wherein said reference point is defined as a "mouth point" of the average patient's head, whose size is empirically identified, said "mouth point" being situated at a defined distance from said headrest part.

18. A dental patient chair according to claim 12, wherein the reference point can be set according to the physical size of the patient by adjusting the headrest part via a backrest.

* * * * *